US010618311B2

(12) United States Patent
Lu et al.

(10) Patent No.: US 10,618,311 B2
(45) Date of Patent: Apr. 14, 2020

(54) LABEL PRINTER

(71) Applicant: TSC AUTO ID TECHNOLOGY CO., LTD., New Taipei (TW)

(72) Inventors: Zhi-Hao Lu, Yilan (TW); Chih-Yu Chen, New Taipei (TW)

(73) Assignee: TSC AUTO ID TECHNOLOGY CO., LTD., New Taipei (TW)

( * ) Notice: Subject to any disclaimer, the term of this patent is extended or adjusted under 35 U.S.C. 154(b) by 61 days.

(21) Appl. No.: 15/866,076

(22) Filed: Jan. 9, 2018

(65) Prior Publication Data

US 2019/0077170 A1 Mar. 14, 2019

(30) Foreign Application Priority Data

Sep. 12, 2017 (TW) ..... 106131132 A

(51) Int. Cl.

| | |
|---|---|
| ***B41J 2/325*** | (2006.01) |
| ***B41J 11/04*** | (2006.01) |
| ***B41J 15/04*** | (2006.01) |
| ***B41J 3/407*** | (2006.01) |
| ***B41J 2/32*** | (2006.01) |

(52) U.S. Cl.

CPC ..... *B41J 2/325* (2013.01); *B41J 2/32* (2013.01); *B41J 3/4075* (2013.01); *B41J 11/04* (2013.01); *B41J 15/04* (2013.01)

(58) Field of Classification Search

CPC ..... B41J 2/325; B41J 2/32; B41J 15/04; B41J 3/4075; B41J 11/04

See application file for complete search history.

(56) References Cited

U.S. PATENT DOCUMENTS 6,123,471 A * 9/2000 Harb ..... B41J 35/08 400/234

2001/0010521 A1* 8/2001 Hayama ..... B41J 3/4075 345/619

* cited by examiner

*Primary Examiner* — Justin Seo

(74) *Attorney, Agent, or Firm* — Hamre, Schumann, Mueller & Larson, P.C.

(57) ABSTRACT

A label printer includes a platen roller, a printing device, a ribbon conveying device, and a peeling assembly disposed within a machine housing which defines a conveyance channel therein for conveying a label sheet, and a print area between the platen roller and the printing device. The peeling assembly has a peeling member which is disposed at an end of the printing device and immediately downstream of the print area, and which has a peeling edge that faces and extends across the print area and that is configured to be inserted between an upper major surface of the label sheet and a carbon ribbon so as to facilitate output of the printed label sheet.

13 Claims, 14 Drawing Sheets

LABEL PRINTER

CROSS-REFERENCE TO RELATED APPLICATION

This application claims priority of Taiwanese Patent Application No. 106131132, filed on Sep. 12, 2017.

FIELD

The disclosure relates to a label printer, and more particularly to a label printer which transfers toners on a carbon ribbon to a label sheet via thermal transfer printing.

BACKGROUND

A conventional thermal transfer printing requires a printer that is provided with a carbon based ribbon. To transfer toners on the carbon based ribbon to a print surface of a label sheet, the carbon based ribbon and the label sheet are overlapped and pressed by a platen roller and a thermal print head while heat is applied. However, the printed label especially for a care label tends to be attached to the ribbon and be rewound with the ribbon by a ribbon rewinding mechanism, which renders succeeding operations troublesome.

SUMMARY

Therefore, an object of the disclosure is to provide a label printer that can alleviate at least one of the drawbacks of the prior art.

According to the disclosure, the label printer is adapted to print on a label sheet and a care label. The label printer includes a machine housing, a platen roller, a printing device, a ribbon conveying device and a peeling assembly. The machine housing defines therein a conveyance channel for conveying the label sheet. The platen roller is disposed within the machine housing, and is placed on an underside of the conveyance channel to press contact the lower major surface of the label sheet. The printing device is disposed within the machine housing, and placed on an upper side of the conveyance channel. The printing device includes a carrier and a print head which is disposed on the carrier and upwardly of the platen roller. The ribbon conveying device is disposed within the machine housing to convey a carbon ribbon between the platen roller and the printing device along the conveyance channel such that the carbon ribbon is superimposed upon the upper major surface of the label sheet in a print area in the conveyance channel to be heated and pressed toward the label sheet by the print head so as to transfer toners on the carbon ribbon to the upper major surface of the label sheet. The peeling assembly is disposed within the machine housing, and has a peeling member which is disposed at an end of the printing device. The peeling member has a peeling edge that is configured to be inserted between the upper major surface of the label sheet and the carbon ribbon. Sticking of the printed label sheet to the ribbon can be avoided.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
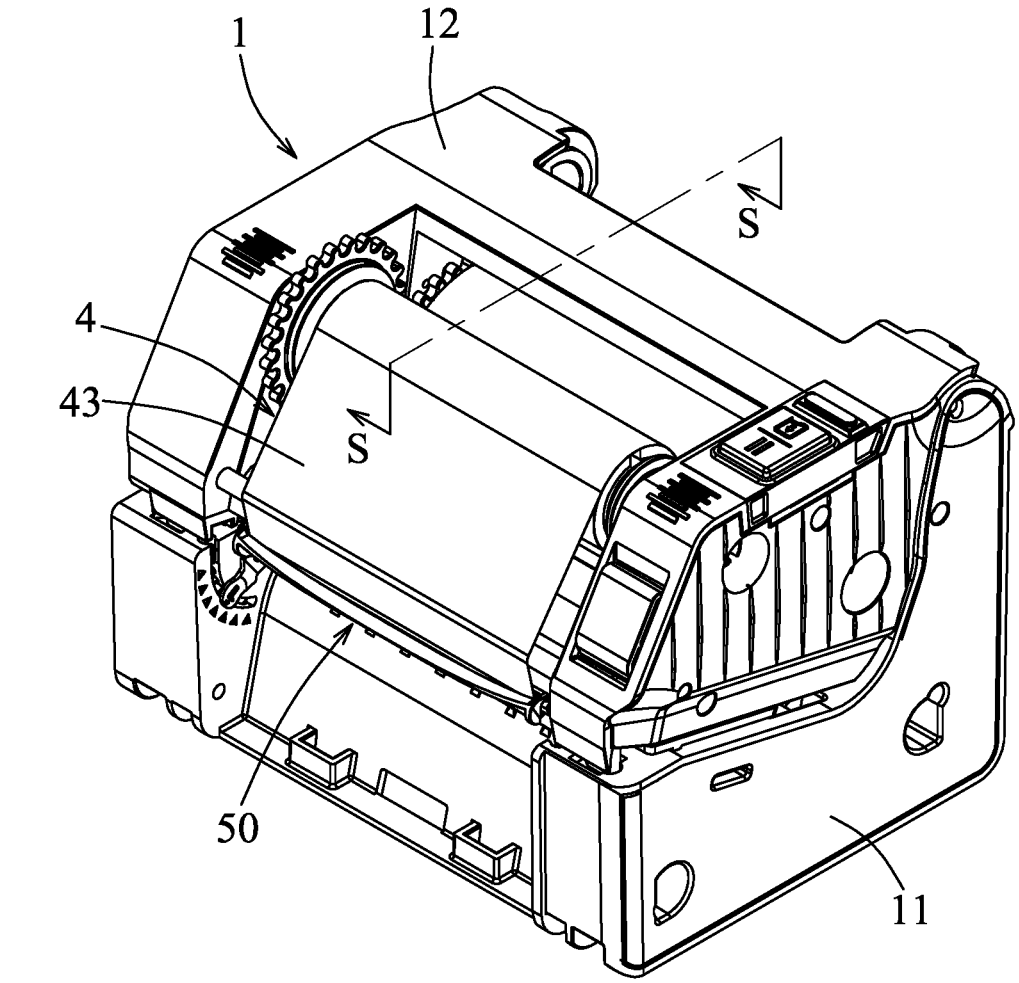
FIG. 1 is a perspective view illustrating a first embodiment of a label printer according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
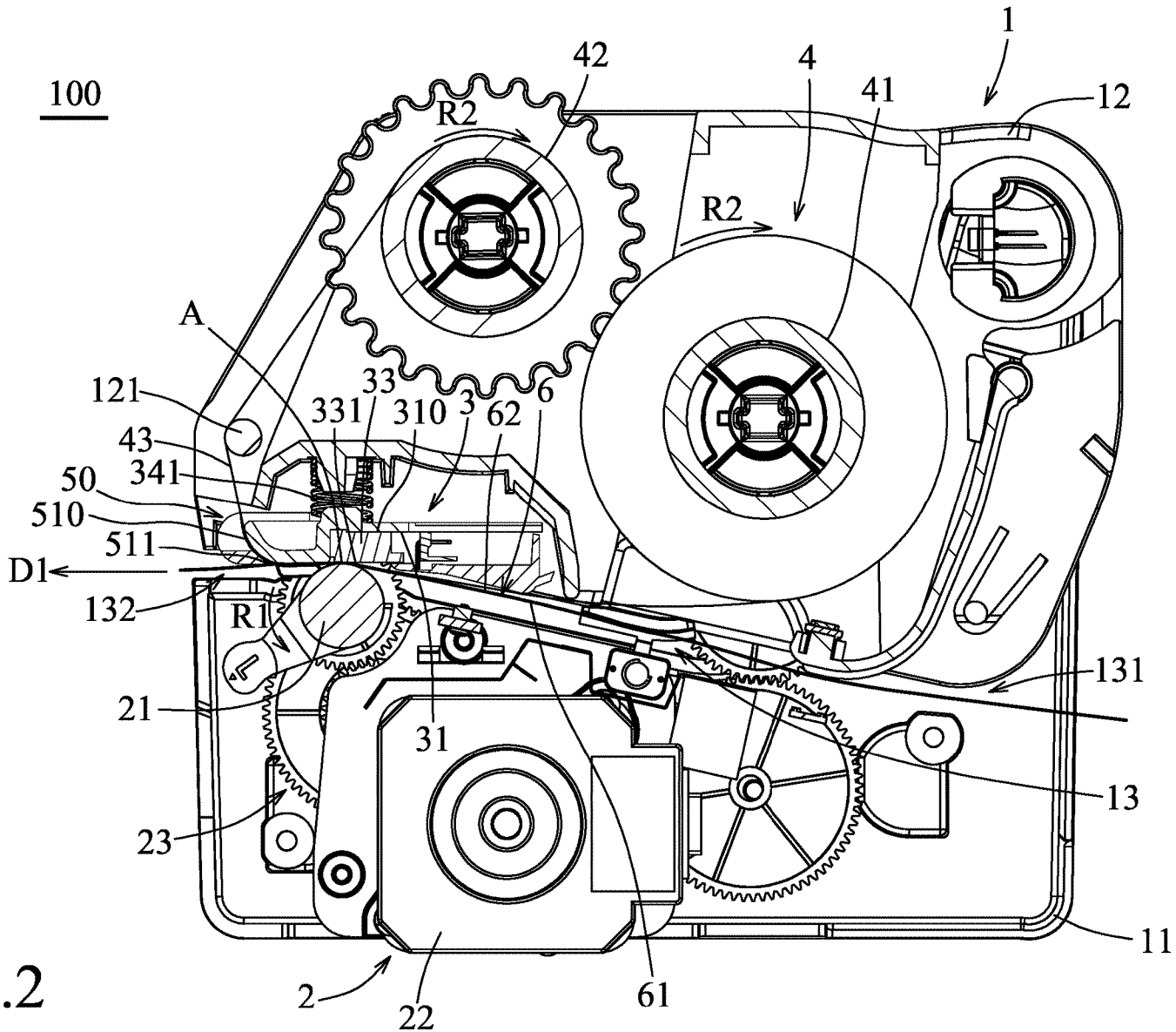
FIG. 2 is a sectional view taken alone line S-S of FIG. 1.

Referring to FIGS. 1 and 2, a first embodiment of a label printer 100 according to the disclosure is adapted to print a label sheet 6. The label sheet 6 has upper and lower major surfaces 62, 61. In this embodiment, the label printer 100 is a care label printer, and the label sheet 6 is a care label sheet made from a fabric, such as nylon or satin.

The label printer 100 includes a machine housing 1, a transporting device 2, a printing device 3, a ribbon conveying device 4 and a peeling assembly 50. The machine housing 1 has a lower housing body 11 and an upper housing body 12 disposed on the lower housing body 11 to cooperatively define a conveyance channel 13 for conveying the label sheet 6. The conveyance channel 13 has a feeding end 131 and an exit end 132 at rear and front ends of the lower housing body 11, respectively.

Figure 3:
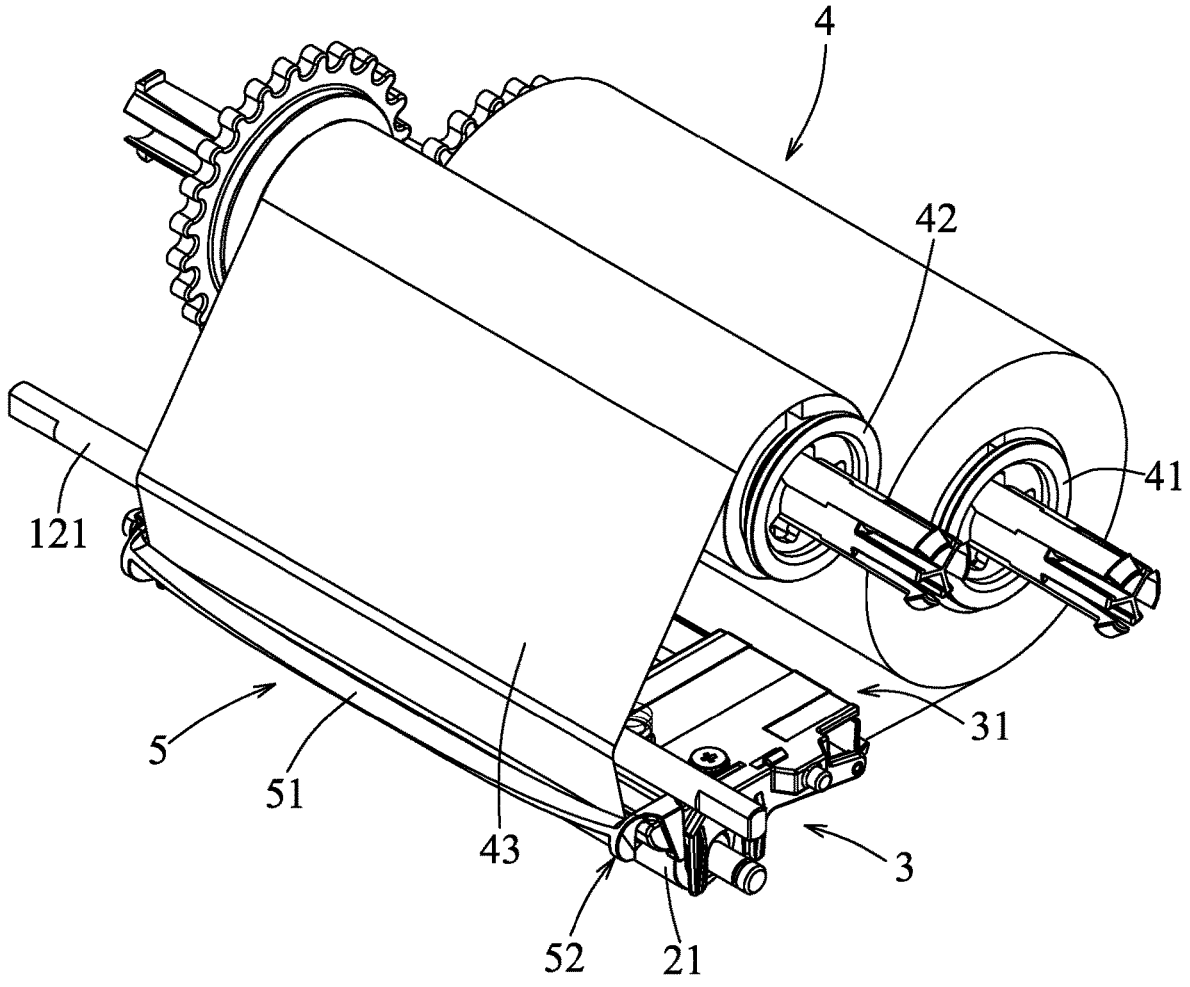
FIG. 3 is a perspective view illustrating a platen roller, a printing device, a ribbon conveying device and a peeling member of the first embodiment.
Figure 4:
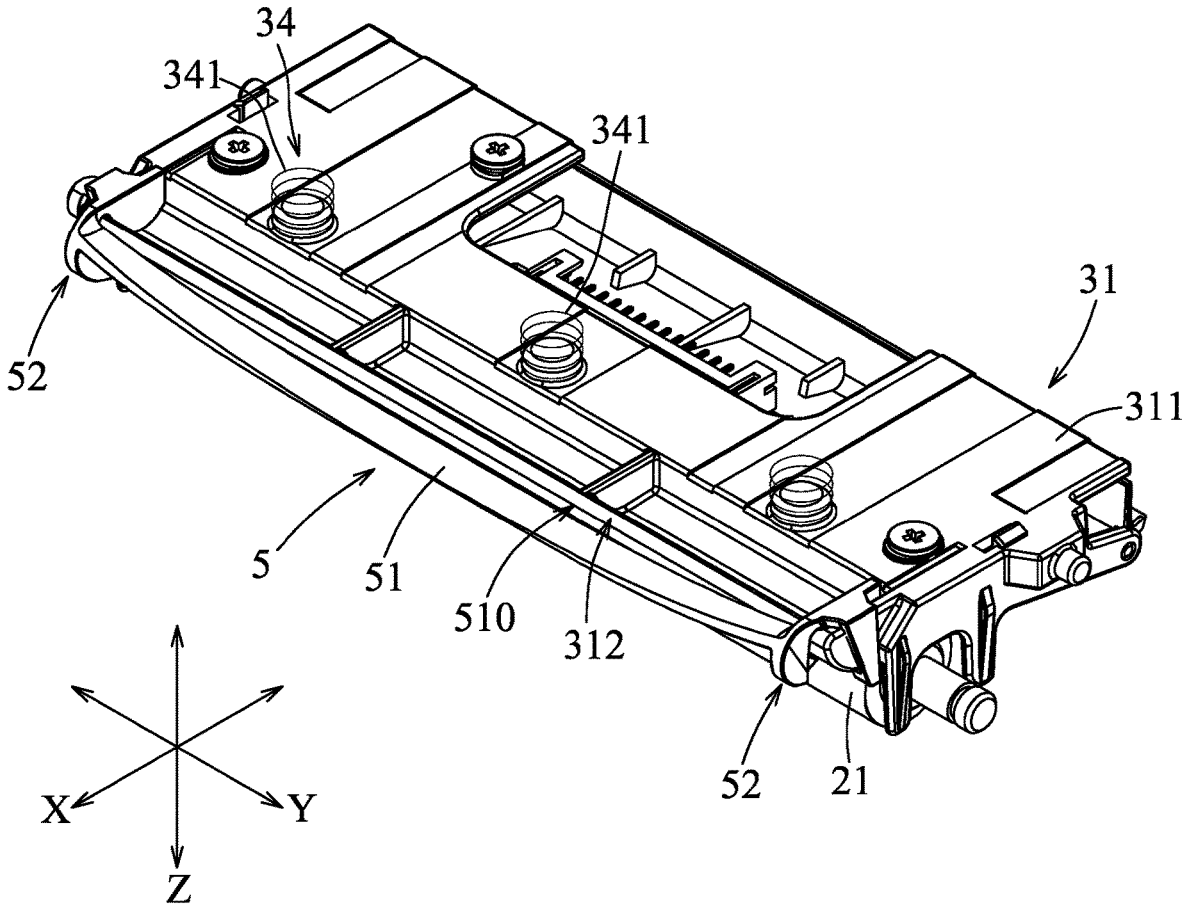
FIG. 4 is a perspective view illustrating the platen roller, the printing device and the peeling member of the first embodiment.

With reference to FIGS. 2 to 4, the transporting device 2 is disposed within the lower housing body 11, and includes a platen roller 21, a motor 22 and a transmitting gear assembly 23. The platen roller 21 is rotatably mounted to the lower housing body 11 to define a lower border of the conveyance channel 13 and is adjacent to the exit end 132 so as to press contact the lower major surface 61 of the label sheet 6 and to convey the label sheet 6 along the conveyance channel 13 by rolling friction. The motor 22 is mounted within the lower housing body 11. The transmitting gear assembly 23 is disposed between the platen roller 21 and the motor 22 to transmit a torque of the motor 22 to rotate the platen roller 21. Specifically, when the motor 22 is rotated clockwise, a torque is transmitted to rotate the platen roller 21 in a first rotational direction (R1), and hence to convey the label sheet 6 in a first conveying direction (D1) along the conveyance channel 13.

The printing device 3 is disposed within the upper housing body 12, and includes a carrier 31, a thermal print head 33 and a biasing assembly 34. The carrier 31 is swingably pivoted to the upper housing body 12 and upwardly of the platen roller 21. The thermal print head 33 is disposed on the carrier 31 to define an upper border of the conveyance channel 13. The print head 33 has a contact surface 331 facing and upwardly of the platen roller 21. The biasing assembly 34 includes a plurality of compression springs 341 each abutting against both the upper housing body 12 and an upper end of the carrier 31 to bias the carrier 31 toward the platen roller 21 so as to urge the contact surface 331 toward the platen roller 21 to hold and press the label sheet 6 together with the platen roller 21.

Referring again to FIGS. 2 and 3, the ribbon conveying device 4 is disposed within the upper housing body 12, and includes a supply reel 41 rotatably pivoted to the upper housing body 12, a rewinding reel 42 rotatably pivoted to the upper housing body 12, a carbon ribbon 43 and a driven gear assembly (not shown). The carbon ribbon 43 has two ends secured to the supply and rewinding reels 41, 42, respectively, and is trained on the carrier 31 and an axle shaft 121 of the upper housing body 12. The driven gear assembly is disposed on the supply and rewinding reels 41, 42 and is coupled with the transmitting gear assembly 23. Thus, when the platen roller 21 is rotated in the first rotational direction (R1), the supply and rewinding reels 41, 42 are rotated in a second rotational direction (R2) opposite to the first rotational direction (R1). With the rotation of the supply and rewinding reels 41, 42 in the second rotational direction (R2), the carbon ribbon 43 can be conveyed between the platen roller 21 and the printing device 3 along the conveyance channel 13. At this stage, the carbon ribbon 43 is superimposed upon the upper major surface 62 of the label sheet 6 in a print area (A) in the conveyance channel 13 to be heated and pressed toward the label sheet 6 by the contact surface 331 of the thermal print head 33 so as to transfer toners on the carbon ribbon 43 to the upper major surface 62 of the label sheet 6.

Figure 5:
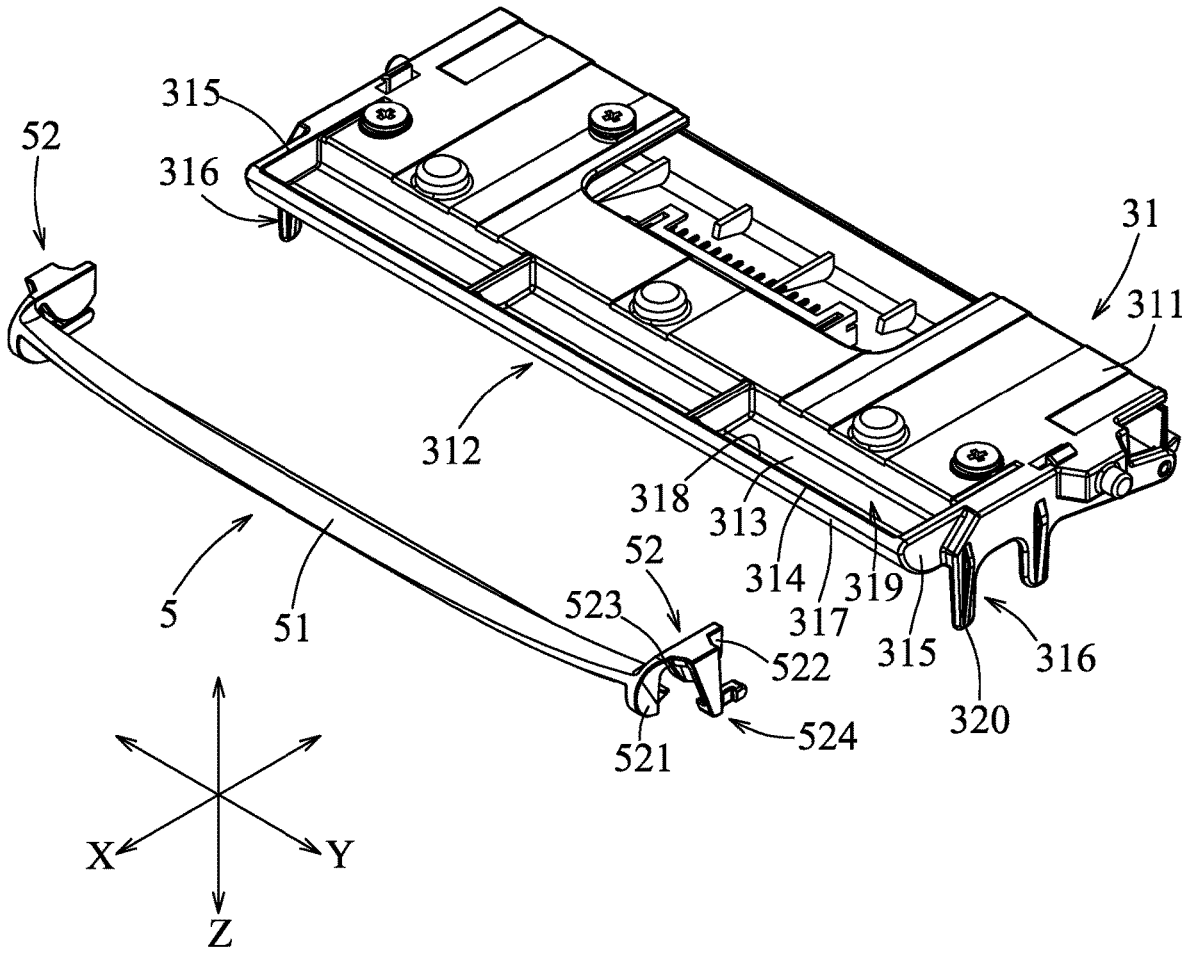
FIG. 5 is an exploded perspective view illustrating a carrier and the peeling member of the first embodiment.
Figure 6:
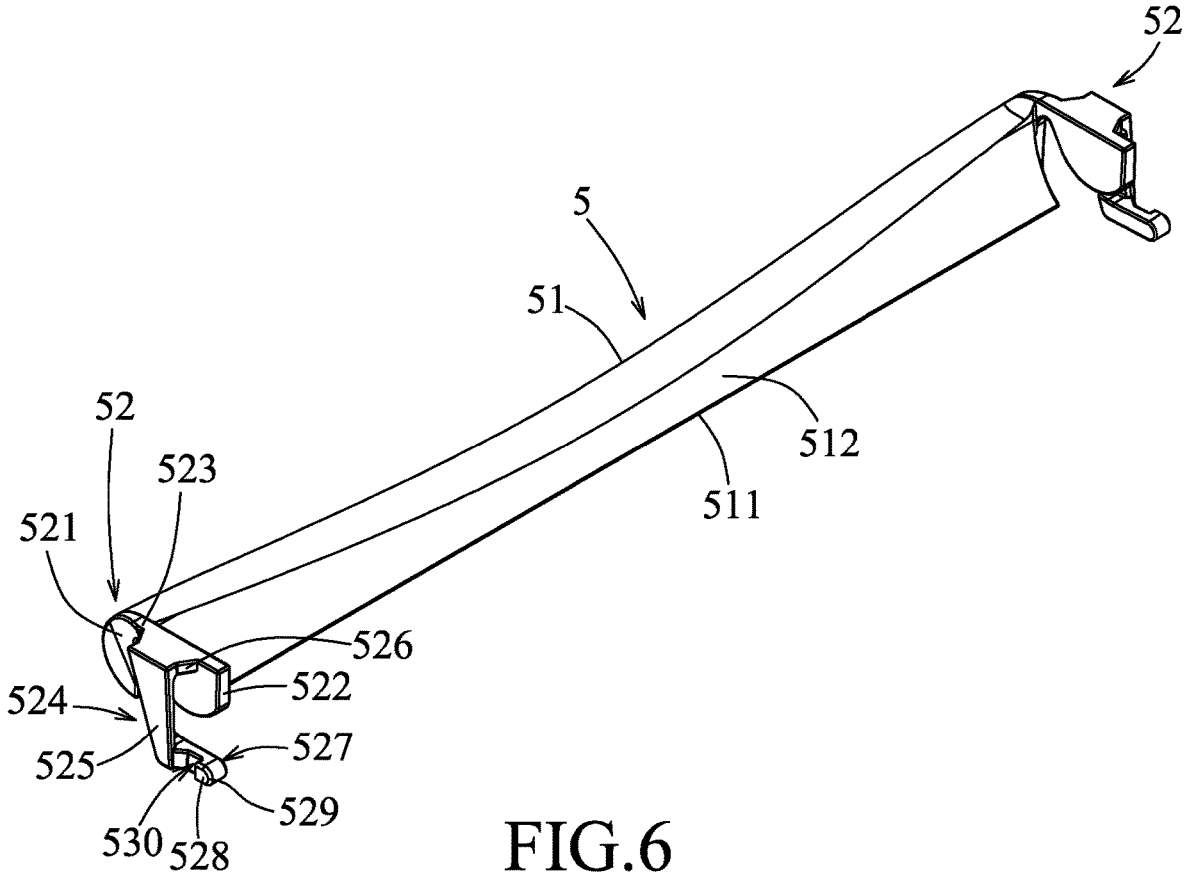
FIG. 6 is a perspective view of the peeling member of the first embodiment.

Referring to FIGS. 2, 4 and 5, the peeling assembly 50 is disposed within the machine housing 1, and includes a peeling member 5 which is disposed at a front end of the printing device 3 and immediately downstream of the print area (A). In this embodiment, the peeling member 5 is disposed on the carrier 31, and has a peeling crosspiece 51 and two suspending arms 52 which are disposed at two opposite ends of the peeling crosspiece 51 and connected to the carrier 31. The peeling crosspiece 51 extends in a left-and-right direction (Y), and is spaced apart from a front end of the carrier 31 to define therebetween a deflect groove 510 that is in spatial communication with the print area (A) to permit passage of the carbon ribbon 43 and that is deflected from the conveyance channel 13. The peeling crosspiece 51 has a peeling edge 511 which is disposed at a juncture between the deflect groove 510 and the conveyance channel 13 and which faces and extends across the print area (A) to peel the label sheet 6 from the carbon ribbon 43. The upper major surface 62 of the label sheet 6 tends to be attached to the carbon ribbon 43 due to thermal press by the thermal print head 33. With the peeling edge 511 which is configured to be inserted between the upper major surface 62 of the label sheet 6 and the carbon ribbon 43, the label sheet 6 can be removed successfully from the carbon ribbon 43 to be outputted from the exit end 132.

The carrier 31 includes a rear carrier body 311 which is swingably pivoted to the upper housing body 12 and which has a downwardly-opened accommodation space 310 for accommodating the thermal print head 33, and a front carrier body 312 which is disposed forwardly from the rear carrier body 311. A lower end of each compression spring 341 abuts against an upper end of the rear carrier body 311. The front carrier body 312 has a bottom wall 313, an end wall 314, two side walls 315 and two retained wings 316. The bottom wall 313 extends forwardly from a front end of the rear carrier body 311, and is spaced apart from the upper end of the rear carrier body 311. The end wall 314 is arcuate and extends forwardly and upwardly from a front end of the bottom wall 313. The end wall 314 has an arcuate outer end surface 317 and an arcuate inner end surface 318 opposite to each other in a front-and-rear direction (X). The side walls 315 extend rearwardly from two lateral ends of the end wall 314 which are opposite to each other in the left-and-right direction (Y), and are connected to the bottom wall 313 and the rear carrier body 311 to cooperatively define a recess 319. The retained wings 316 are disposed outboard of and extend respectively and downwardly from the side walls 315.

With reference to FIGS. 5 to 8, the peeling crosspiece 51 has an arcuate guide surface 512 which extends upwardly from the peeling edge 511 and which faces the outer end surface 317 of the end wall 314 to cooperatively define the deflect groove 510. With the deflect groove 510 defined by the guide surface 512 and the outer end surface 317, the carbon ribbon 43 is deflected to be conveyed smoothly.

Each of the suspending arms 52 has a front abutting portion 521, a rear abutting portion 522, a connecting portion 523 and an arm body 524. The front abutting portion 521 extends downwardly from the end of the peeling crosspiece 51 and abuts against the outer end surface 317 of the end wall 314. The rear abutting portion 522 is spaced apart from the front abutting portion 521 in the front-and-rear direction (X), and is accommodated in the recess 319 to abut against the inner end surface 318. The rear abutting portion 522 further abuts against the respective side wall 315. The connecting portion 523 interconnects the front and rear abutting portions 521, 522, is adjacent to upper ends of the front and rear abutting portions 521, 522, and is disposed on an upper edge of the end wall 314.

The arm body 524 is connected to the rear abutting portion 522, is adjacent to the upper end of the rear abutting portion 522, and has lateral, upper and lower abutting portions 525, 526, 527. The lateral abutting portion 525 is spaced apart from the rear abutting portion 522 in the left-and-right direction (Y) to cooperate with the rear abutting portion 522 to sandwich the respective side wall 315 in the left-and-right direction (Y). The upper and lower abutting portions 526, 527 project from the lateral abutting portion 525, and are spaced apart from each other in an up-and-down direction (Z) to cooperatively sandwich the respective side wall 315 in the up-and-down direction (Z).

Figure 7:
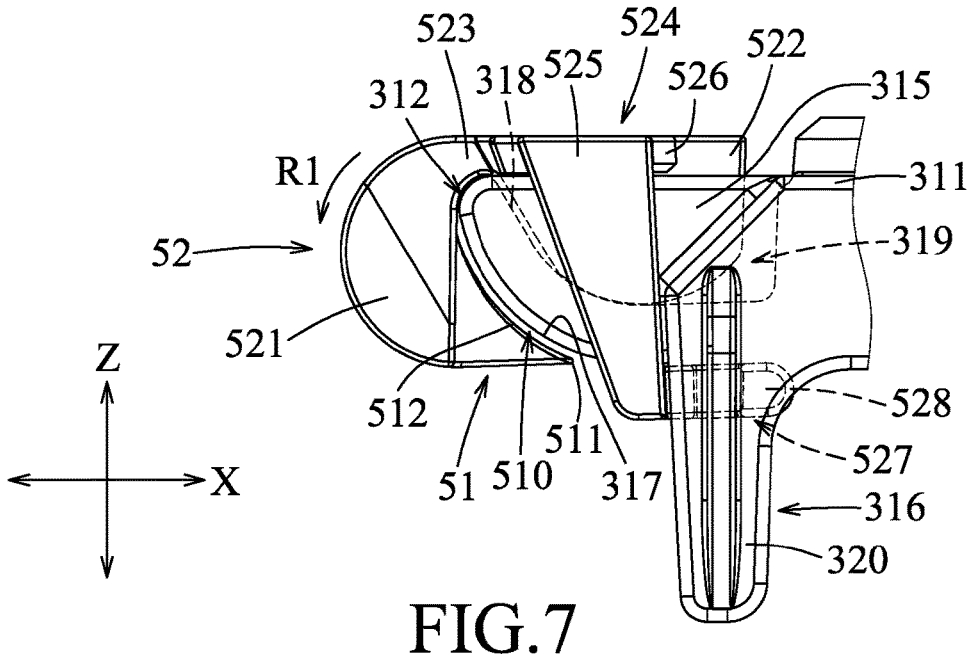
FIG. 7 is a fragmentary side view illustrating a suspending arm of the peeling member and the carrier of the first embodiment.
Figure 8:
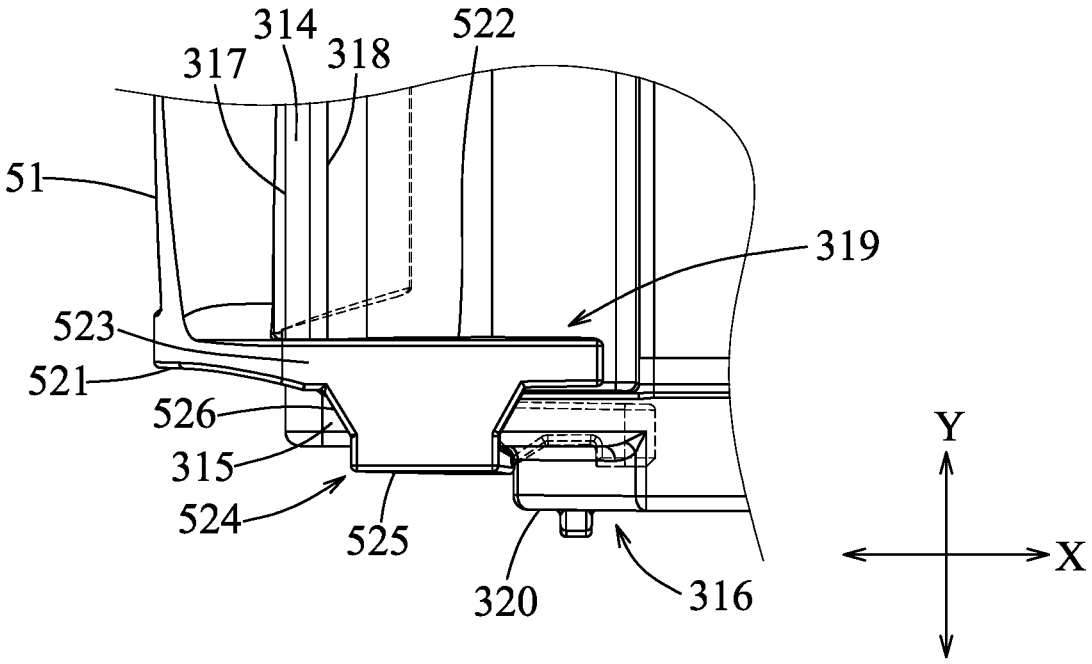
FIG. 8 is a fragmentary top view illustrating the suspending arm and the carrier of the first embodiment.
Figure 9:
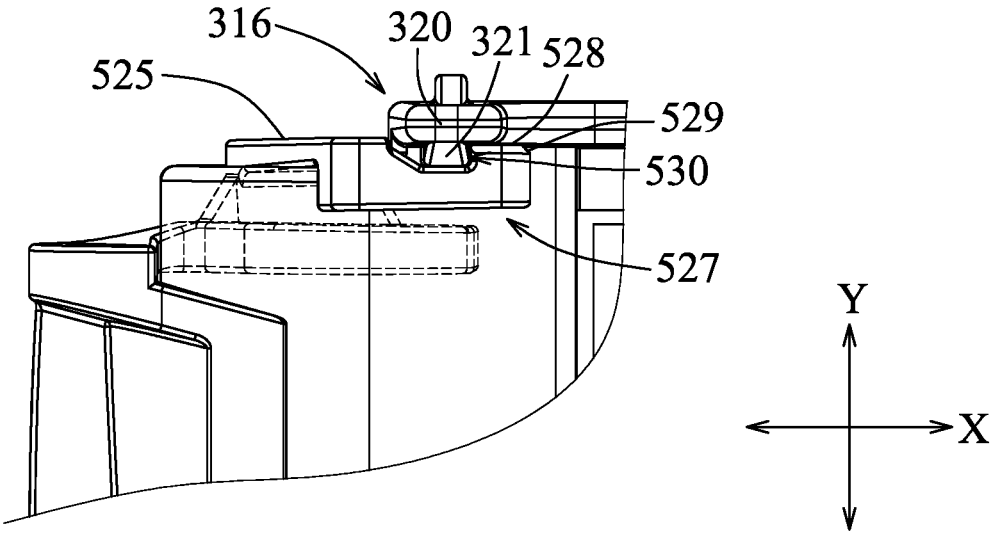
FIG. 9 is a fragmentary bottom view illustrating the suspending arm and the carrier of the first embodiment.

With reference to FIGS. 7 and 9, in this embodiment, each retained wing 316 has an upright wing body 320 and a rib 321 projecting from the wing body 320. The lower abutting portion 527 extends rearwardly from the lateral abutting portion 525 to terminate at a protrusion 528. The lateral abutting portion 525 abuts against a front end of the wing body 320 and the protrusion 528 abuts against a rear end of the rib 321 such that the respective retained wing 316 is sandwiched between the lateral abutting portion 525 and the protrusion 528 in the front-and-rear direction (X).

With reference to FIGS. 5, 7, 8 and 9, when it is desired to assemble the peeling member 5 to the front carrier body 312, the peeling member 5 is inclined relative to the front carrier body 312 by an appropriate angle to permit insertion of the rear abutting portions 522 into the recess 319. The peeling member 5 is then rotated in the first rotational direction (R1) so as to gradually move the peeling cross-piece 51 to face and be forward of the outer end surface 317 of the end wall 314 while the lower abutting portions 527 are gradually moved near the ribs 321 of the retained wings 316. During the movement, the lower abutting portions 527 are bent inwardly by contact of a chamfer 529 of the protrusions 528 with the ribs 321, and then are returned to the original forms when the protrusions 528 pass over the ribs 321 so that the lateral abutting portions 525 abut against the front ends of the wing bodies 320. At this stage, a recess 530 between the protrusion 528 and the lateral abutting portion 525 of each arm body 524 is aligned with the respective rib 321 such that the respective retained wing 316 is sandwiched between the lateral abutting portion 525 and the protrusion 528 with the rib 321 being retained in the recess 530.

With the abutment of the front and rear abutting portions 521, 522 against the outer and inner end surfaces 317, 318, each suspending arm 52 is restricted from movement relative to the front carrier body 312 in the front-and-rear direction (X). With the side wall 315 sandwiched between the rear abutting portion 522 and the lateral abutting portion 525, each suspending arm 52 is restricted from movement relative to the front carrier body 312 in the left-and-right direction (Y). Also, with the side wall 315 sandwiched between the upper and lower abutting portions 526, 527, each suspending arm 52 is restricted from movement relative to the front carrier body 312 in the up-and-down direction (Z). Moreover, with the retained wing 316 sandwiched between the lateral abutting portion 525 and the protrusion 528, the arm body 524 is restricted from movement relative to the retained wing 316 in the front-and-rear direction (X), and the rotation of the peeling member 5 relative to the front carrier body 312 in a second rotational direction (R2) opposite to the first rotational direction (R1) is prevented. Thus, the peeling member 5 is firmly retained and connected to the front carrier body 312 so as to prevent swaying of the peeling member 5 during a peeling operation of the label sheet 6 from the carbon ribbon 43.

Figure 10:
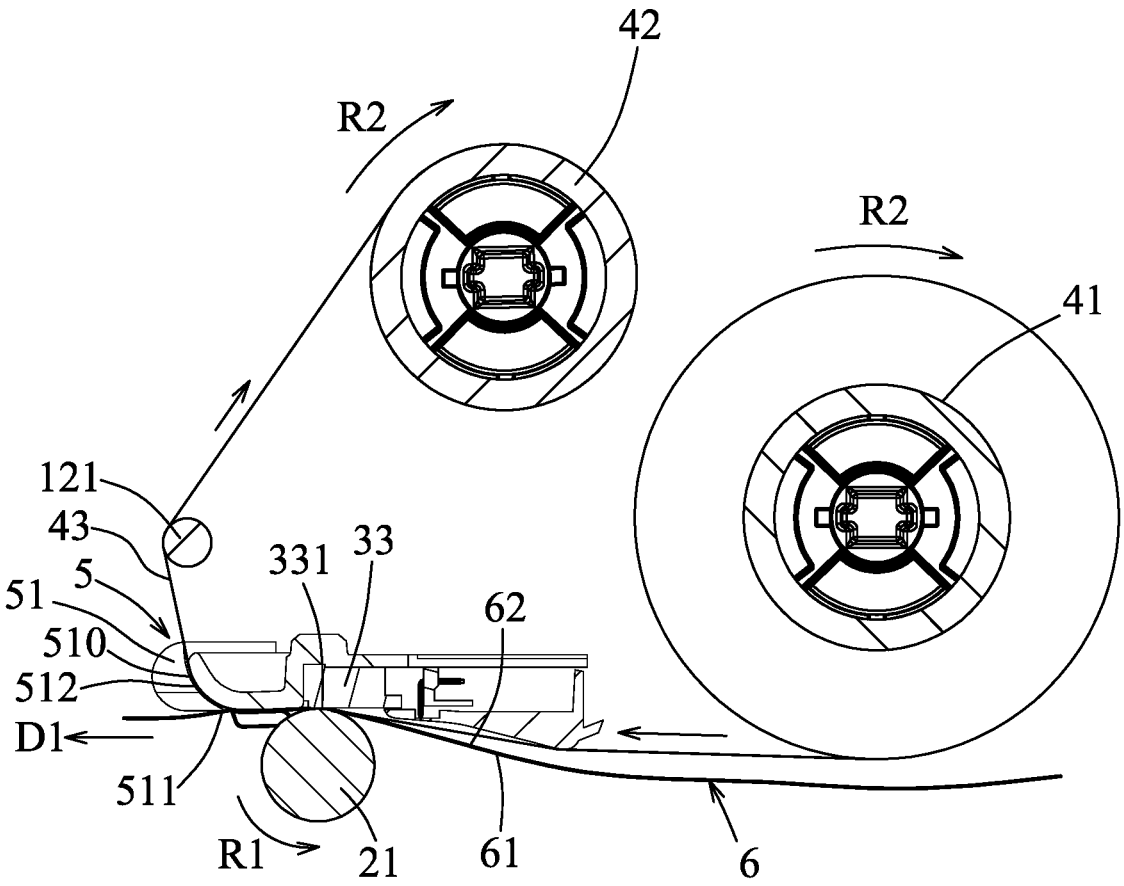
FIG. 10 is a schematic view of the first embodiment, illustrating a label sheet and a carbon ribbon conveyed in a first conveying direction.
Figure 11:
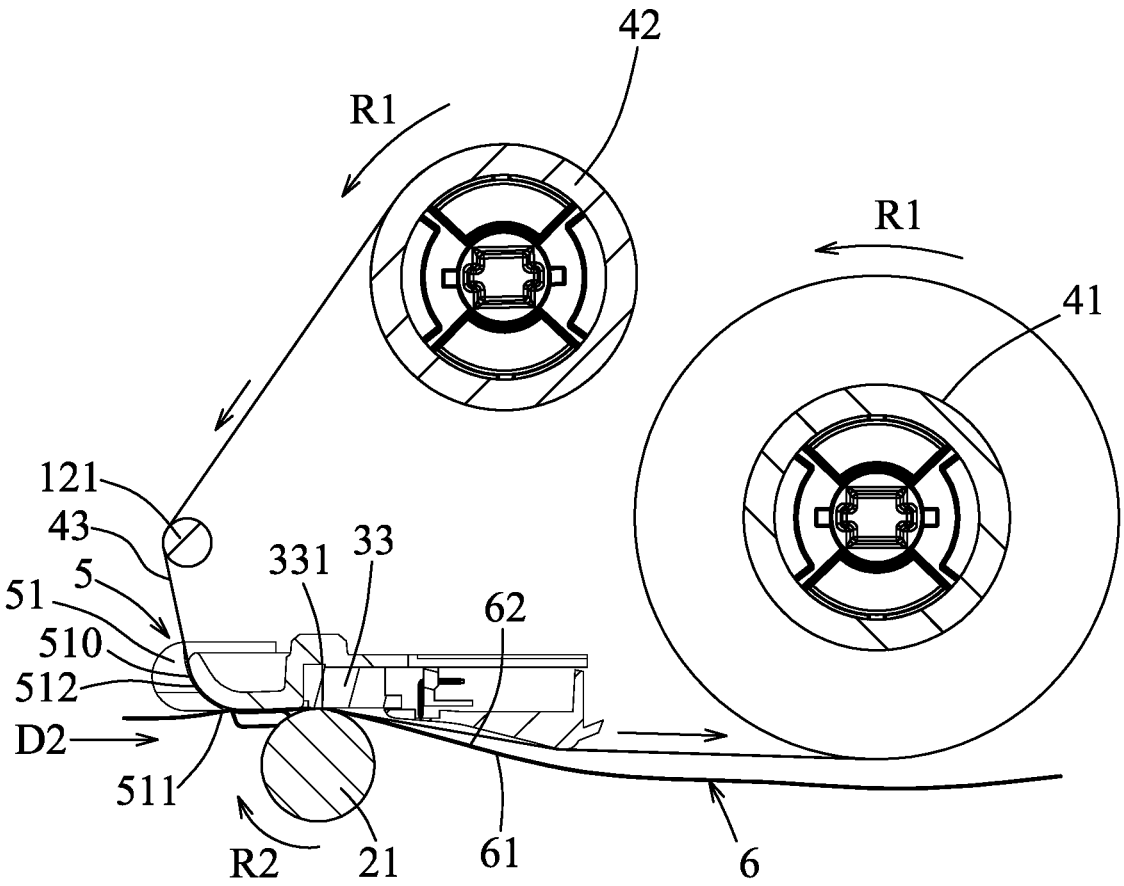
FIG. 11 is a schematic view of the first embodiment, illustrating the label sheet and the carbon ribbon conveyed in a second conveying direction.

As shown in FIGS. 2, 10 and 11, when the motor 22 is initiated to rotate clockwise, a torque is transmitted to rotate the platen roller 21 in the first rotational direction (R1), and hence to convey the label sheet 6 in the first conveying direction (D1) along the conveyance channel 13. Meanwhile, the supply and rewinding reels 41, 42 are rotated in the second rotational direction (R2) to superimpose the carbon ribbon 43 upon the upper major surface 62 of the label sheet 6, so that the carbon ribbon 43 and the label sheet 6 are moved in the first conveying direction (D1) and are conveyed to the print area (A). Subsequently, the motor 22 is rotated counterclockwise to rotate the platen roller 21 in the second rotational direction (R2), and hence the label sheet 6 is conveyed along the conveyance channel 13 in a second conveying direction (D2). Meanwhile, the supply and rewinding reels 41, 42 are rotated in the first rotational direction (R1) to move the carbon ribbon 43 and the label sheet 6 through the print area (A) in the second conveying direction (D2). With alternating clockwise and counter-clockwise rotations of the motor 22, the carbon ribbon 43 and the label sheet 6 are moved reciprocately in the print area (A) to be heated and pressed by the contact surface 331 of the thermal print head 33 so as to thermal transfer toners on the carbon ribbon 43 to the upper major surface 62 of the label sheet 6.

After the thermal transfer printing process is completed, the upper major surface 62 of the label sheet 6 is attached tightly to the carbon ribbon 43 and is conveyed therewith in the first conveying direction (D1). The carbon ribbon 43 is conveyed upwardly through the deflect groove 510. At this stage, with the peeling member 5 having the peeling edge 511 facing and extending across the print area (A) and being inserted between the upper major surface 62 of the label sheet 6 and the carbon ribbon 43, the label sheet 6 can be removed from the carbon ribbon 43 to be outputted successfully from the exit end 132.

Figure 12:
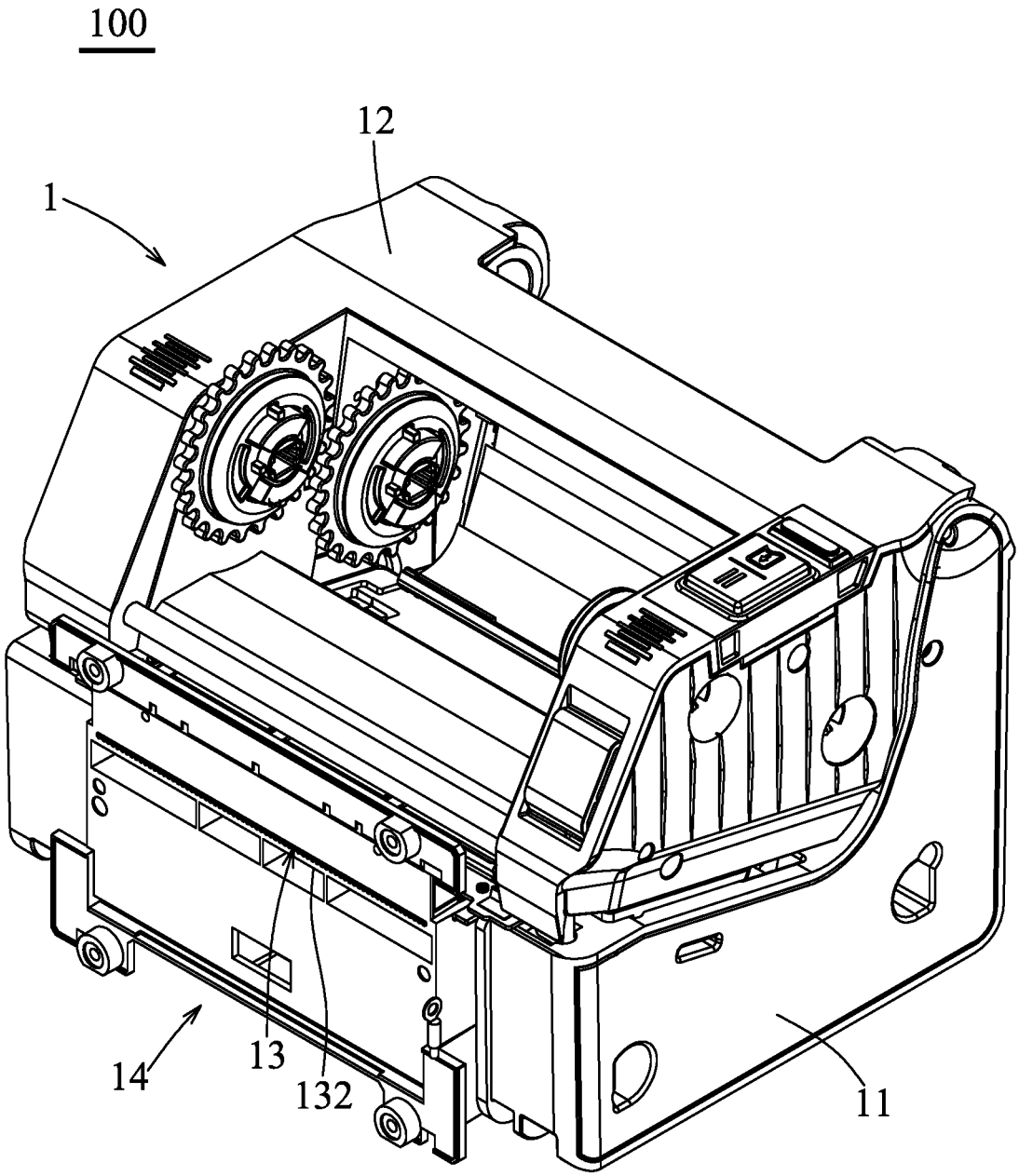
FIG. 12 is a perspective view illustrating a second embodiment of a label printer according to the disclosure.
Figure 13:
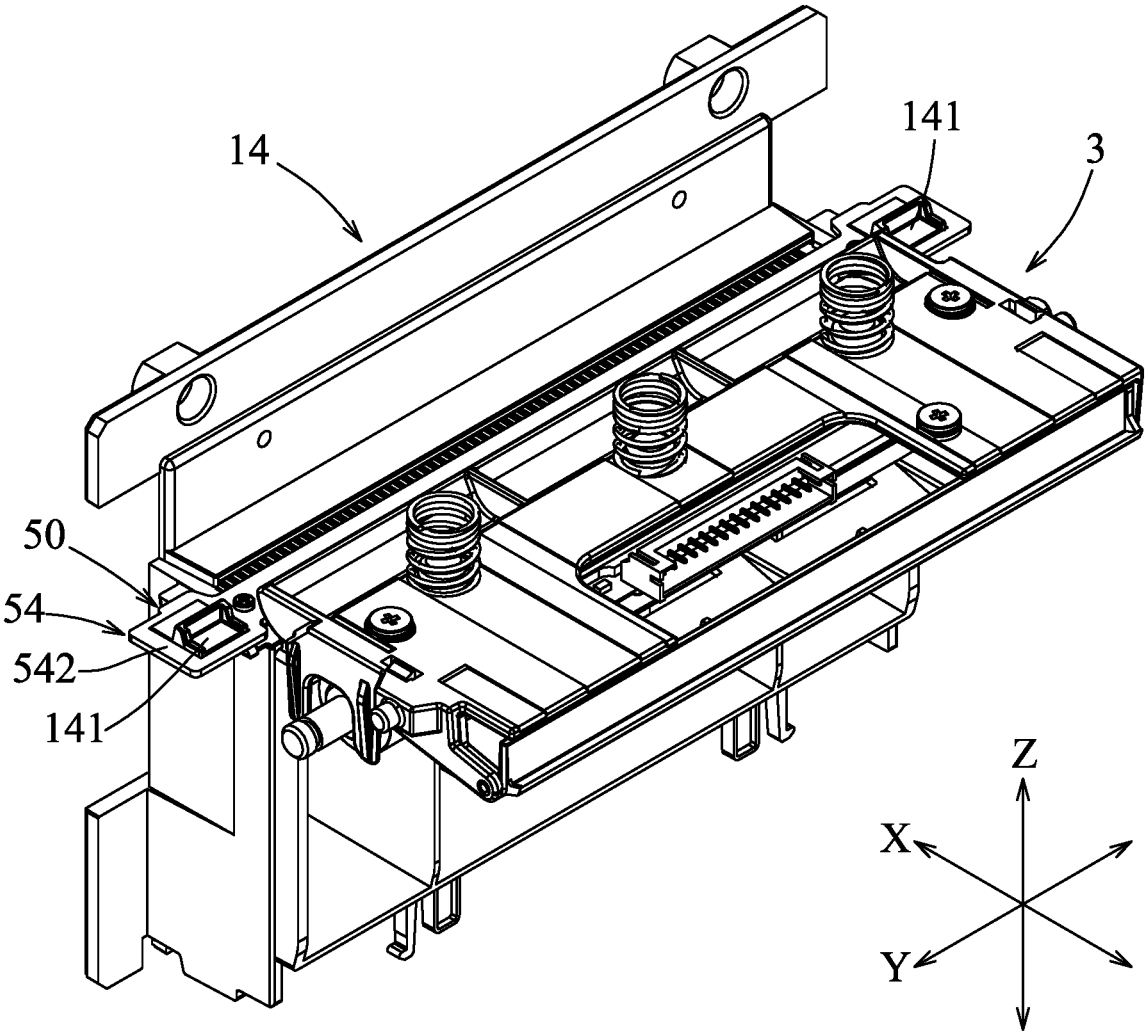
FIG. 13 is a perspective view illustrating a printing device, a cutter mounting frame and a peeling assembly of the second embodiment.
Figure 16:
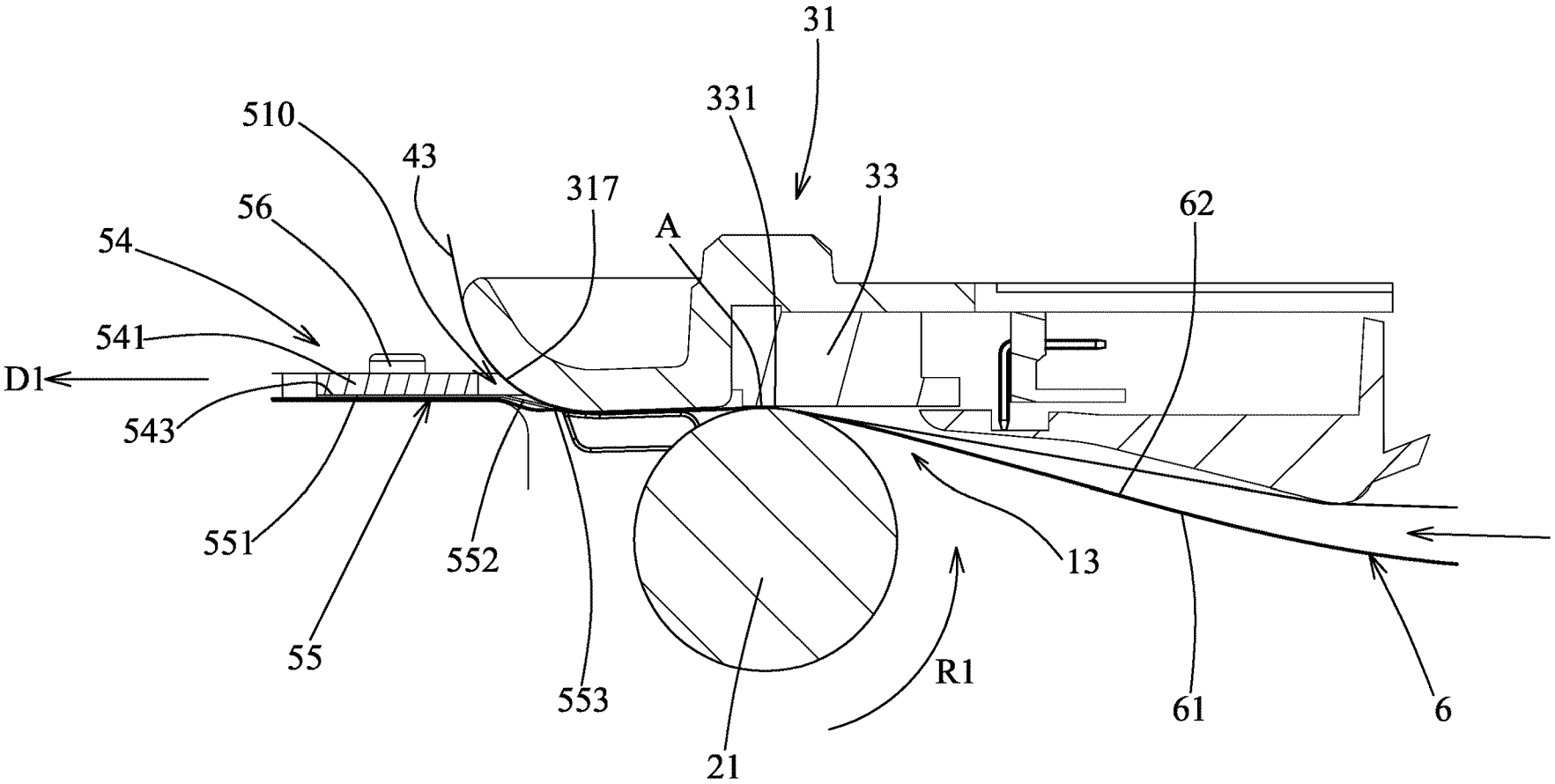
FIG. 16 is a schematic sectional view of the second embodiment.

Referring to FIGS. 12 and 13, in a second embodiment, the machine housing 1 further includes a cutter mounting frame 14 which is disposed forwardly of the front end of the printing device 3. A cutter (not shown) is disposed on the cutter mounting frame 14 for cutting the printed label sheet 6 (as shown in FIG. 16). The cutter mounting frame 14 is disposed on the front end of the printing device 3 and cooperates with the upper and lower housing bodies 12, 11 to define the conveyance channel 13. The cutter mounting frame 14 has two positioning plugs 141 disposed at two ends which are opposite to each other in the left-and-right direction (Y). Each positioning plug 141 is rectangular in shape.

Figure 14:
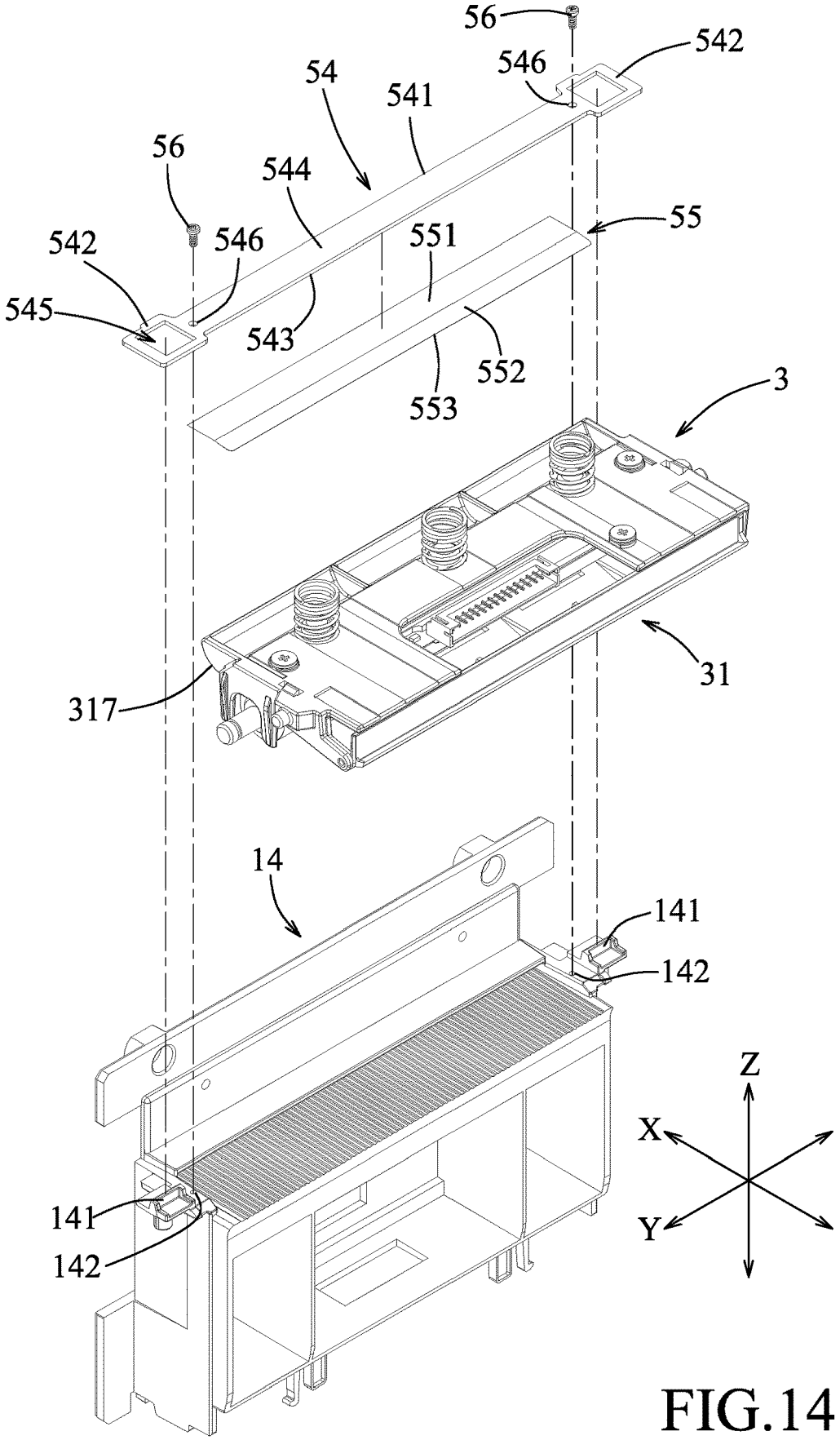
FIG. 14 is an exploded perspective view illustrating the printing device, the cutter mounting frame and the peeling assembly of the second embodiment.
Figure 15:
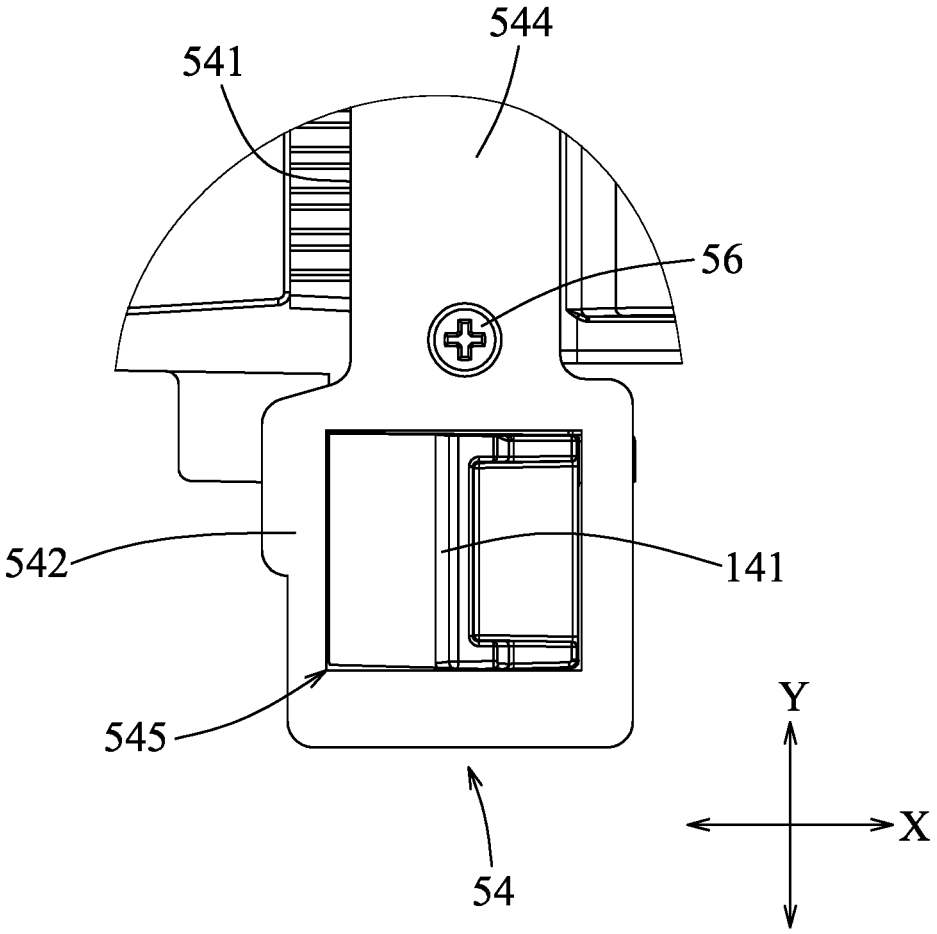
FIG. 15 is a fragmentary top view illustrating a positioning plate of the peeling assembly connected to the cutter mounting frame of the second embodiment.

With reference to FIGS. 13 to 15, the peeling assembly 50 is disposed on the cutter mounting frame 14, and includes a positioning plate 54 and the peeling member 55. The positioning plate 54 is mounted on and extends rearwardly from the cutter mounting frame 14, and has a plate body 541 which extends in the left-and-right direction (Y) to terminate at two socket ends 542. The plate body 541 has a rear end which is spaced apart from the arcuate outer end surface 317 of the carrier 31 to define therebetween the deflect groove 510 (see FIG. 16) that is in spatial communication with the print area (A) to permit passage of the carbon ribbon 43 and that is deflected from the conveyance channel 13. The positioning plate 54 has a lower plate surface 543, an upper plate surface 544 opposite to the lower plate surface 543, and two through holes 546 which extend through the upper and lower plate surfaces 544, 543. The socket ends 542 have rectangular holes 545 to be matingly sleeved on and engaged with the positioning plugs 141, respectively, so as to retain the positioning plate 54 to the cutter mounting frame 14 to prevent movement in both the front-and-rear direction (X) and the left-and-right direction (Y).

Referring to FIGS. 14 and 16, the peeling member 55 is in a form of a flexible sheet which is elongated in the left-and-right direction (Y) and which is disposed downstream of the print area (A). In this embodiment, the flexible sheet is made from a polyester material, such as a Mylar sheet. The peeling member 55 has a connected sheet portion 551 which is secured to the lower plate surface 543 by adhesives, and an inclined sheet portion 552 which extends rearwardly and is inclined downwardly from the connected sheet portion 551 to terminate at the peeling edge 553.

Specifically, as shown in FIGS. 14 and 15, the cutter mounting frame 14 has two screw holes 142 formed adjacent to the positioning plugs 141, respectively. The through holes 546 of the plate body 541 are aligned with the screw holes 142, respectively. The peeling assembly 50 further has two screws 56 each of which extends through the respective through hole 546 and is threadedly engaged in the respective screw hole 142 so as to secure the positioning plate 54 to the cutter mounting frame 14 to prevent movement of the positioning plate 54 in the up-and-down direction (Z).

When it is desired to assemble the peeling assembly 50 to the cutter mounting frame 14, the socket ends 542 of the positioning plate 54 are first aligned with and sleeved on the positioning plugs 141, respectively, to retain the positioning plate 54 in both the front-and-rear direction (X) and the left-and-right direction (Y) and to align the through holes 546 with the screw holes 142. Subsequently, the screws 56 extend through the through holes 546 and are threadedly engaged in the screw holes 142 so as to retain the positioning plate 54 in the up-and-down direction (Z).

As illustrated, with the peeling member 5, 55 of the peeling assembly 50 having the peeling edge 511 facing and extending across the print area (A) and being inserted between the upper major surface 62 of the label sheet 6 and the carbon ribbon 43, the label sheet 6 can be removed from the carbon ribbon 43 to be outputted successfully from the exit end 132. Moreover, the peeling assembly 50 can be conveniently and readily assembled on the front carrier body 312 of the carrier 31 or the cutter mounting frame 14. Furthermore, the peeling assembly 50 can be firmly secured and connected to the front carrier body 312 or the cutter mounting frame 14 to prevent undesired swaying of the peeling member 5 during a peeling operation of the label sheet 6 from the carbon ribbon 43.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A label printer adapted to print on a label sheet which has upper and lower major surfaces, comprising:

a machine housing defining therein a conveyance channel for conveying the label sheet;

a platen roller disposed within said machine housing and placed on an underside of said conveyance channel to press contact the lower major surface of the label sheet;

a printing device disposed within said machine housing and placed on an upper side of said conveyance channel, said printing device including a carrier and a print head which is disposed on said carrier and upwardly of said platen roller;

a ribbon conveying device disposed within said machine housing to convey a carbon ribbon between said platen roller and said printing device along said conveyance channel such that the carbon ribbon is superimposed upon the upper major surface of the label sheet in a print area in said conveyance channel to be heated and pressed toward the label sheet by said print head so as to transfer toners on the carbon ribbon to the upper major surface of the label sheet; and a peeling assembly disposed within said machine housing and placed on said upper side of said conveyance channel, said peeling assembly including a peeling member which is disposed at an end of said printing device, said peeling member having a peeling edge that is configured to be inserted between the upper major surface of the label sheet and the carbon ribbon wherein said machine housing defines a deflect groove which is in spatial communication with said print area to permit passage of the carbon ribbon which is deflected from said conveyance channel, said peeling edge being disposed at a juncture between said deflect groove and said conveyance channel.

2. The label printer as claimed in claim 1, wherein said peeling member is disposed on said carrier, and has a peeling crosspiece which is spaced apart from said carrier to define therebetween said deflect groove.

3. The label printer as claimed in claim 2, wherein said peeling member has two suspending arms which are disposed at two opposite ends of said peeling crosspiece and connected to said carrier.

4. The label printer as claimed in claim 3, wherein said carrier has an arcuate outer end surface, said peeling crosspiece having an arcuate guide surface which extends upwardly from said peeling edge and which faces said outer end surface to cooperatively define said deflect groove.

5. The label printer as claimed in claim 4, wherein said carrier has an end wall having said outer end surface and an arcuate inner end surface opposite to said outer end surface, each of said suspending arms having a front abutting portion which extends downwardly from said end of said peeling crosspiece and which abuts against said outer end surface, a rear abutting portion which is spaced apart from said front abutting portion in a front-and-rear direction and which abuts against said inner end surface, and a connecting portion which interconnects said front and rear abutting portions and which is disposed on an upper edge of said end wall.

6. The label printer as claimed in claim 5, wherein said carrier has two side walls extending rearwardly from two lateral ends of said end wall which are opposite to each other in a left-and-right direction, each of said suspending arms having an arm body which is connected to said rear abutting portion and which has a lateral abutting portion that is spaced apart from said rear abutting portion in the left-and-right direction to cooperate therewith to sandwich a respective one of said side walls in the left-and-right direction.

7. The label printer as claimed in claim 6, wherein said arm body has upper and lower abutting portions which project from said lateral abutting portion and which are spaced apart from each other in an up-and-down direction to cooperatively sandwich the respective one of said side walls in the up-and-down direction.

8. The label printer as claimed in claim 7, wherein said carrier has two retained wings which are disposed outboard of and extend respectively and downwardly from said side walls, said lower abutting portion extending rearwardly from said lateral abutting portion to terminate at a protrusion such that a respective one of said retained wings is sandwiched between said lateral abutting portion and said protrusion in the front-and-rear direction.

9. The label printer as claimed in claim 1, wherein said machine housing has a cutter mounting frame which is disposed forwardly of said end of said printing device, said peeling assembly being disposed on said cutter mounting frame, said peeling member being in a form of a flexible sheet.

10. The label printer as claimed in claim 9, wherein said flexible sheet is made from a polyester material.

11. The label printer as claimed in claim 9, wherein said peeling assembly has a positioning plate which is mounted on and extends rearwardly from said cutter mounting frame and which is spaced apart from said carrier to define therebetween said deflect groove, said positioning plate having a lower plate surface, said peeling member having a connected sheet portion which is secured to said lower plate surface, and an inclined sheet portion which extends rearwardly and is inclined downwardly from said connected sheet portion to terminate at said peeling edge.

12. The label printer as claimed in claim 11, wherein said cutter mounting frame has two positioning plugs disposed at two ends opposite to each other in a left-and-right direction, said positioning plate having a plate body which extends in the left-and-right direction to terminate at two socket ends and which cooperates with said carrier to define said deflect groove, said socket ends being engaged with said positioning plugs, respectively.

13. The label printer as claimed in claim 12, wherein said cutter mounting frame has two screw holes formed adjacent to said positioning plugs, respectively, said plate body having said lower plate surface, an upper plate surface opposite to said lower plate surface, and two through holes which extend through said upper and lower plate surfaces and which are aligned with said screw holes, respectively, said peeling assembly having two screws each of which extends through a respective one of said through holes and is threadedly engaged in a respective one of said screw holes.

* * * * *